US007362045B2

(12) United States Patent
Lee et al.

(10) Patent No.: US 7,362,045 B2
(45) Date of Patent: Apr. 22, 2008

(54) FIELD EMISSION DISPLAY HAVING GRID PLATE

(75) Inventors: Byong-Gon Lee, Suwon-si (KR); Eung-Joon Chi, Seoul (KR); Jong-Min Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 454 days.

(21) Appl. No.: 10/774,750

(22) Filed: Feb. 9, 2004

(65) Prior Publication Data

US 2004/0227452 A1 Nov. 18, 2004

(30) Foreign Application Priority Data

Feb. 14, 2003 (KR) ..... 2003-0009439

(51) Int. Cl.

| | |
|---|---|
| ***H01J 1/46*** | (2006.01) |
| ***H01J 21/10*** | (2006.01) |
| ***H01J 1/62*** | (2006.01) |
| ***H01J 63/04*** | (2006.01) |

(52) U.S. Cl. ..... 313/495; 313/292; 313/293; 313/497

(58) Field of Classification Search ..... 313/495–497, 313/293

See application file for complete search history.

(56) References Cited

U.S. PATENT DOCUMENTS

| | | | | |
|---|---|---|---|---|
| 6,400,091 | B1 * | 6/2002 | Deguchi et al. | 315/169.1 |
| 6,621,232 | B2 * | 9/2003 | Jo et al. | 313/495 |
| 6,756,729 | B1 * | 6/2004 | Na et al. | 313/496 |
| 6,791,278 | B2 * | 9/2004 | Russ et al. | 313/310 |
| 7,090,555 | B2 * | 8/2006 | Lee et al. | 313/292 |
| 2002/0017875 | A1 * | 2/2002 | Lee et al. | 313/495 |
| 2002/0036460 | A1 * | 3/2002 | Takenaka et al. | 313/495 |
| 2005/0077812 | A1 * | 4/2005 | Takenaka et al. | 313/495 |
| 2005/0116600 | A1 * | 6/2005 | Chi et al. | 313/495 |

FOREIGN PATENT DOCUMENTS

| | | |
|---|---|---|
| KR | 2001-0046803 | 6/2001 |
| KR | 2002-0078977 | 10/2002 |

OTHER PUBLICATIONS

Korean Patent Abstract, Publication Number 1020010046803 A, Published Jun. 15, 2001, in the name of Seok Yun Han, et al.
Korean Patent Abstract, Publication Number 1020020078977 A, Published Oct. 19, 2002, in the name of Jae Cheol Cha, et al.

* cited by examiner

*Primary Examiner*—Mariceli Santiago
(74) *Attorney, Agent, or Firm*—Christie, Parker & Hale, LLP

(57) ABSTRACT

A field emission display includes a first substrate and a second substrate that face one another with a predetermined gap therebetween. An electron emission assembly that emits electrons by generating an electric field is formed on the first substrate, and an illumination assembly that realizes the display of images responsive to the emitted electrons is formed on the second substrate. A grid plate is mounted between the first and second substrates and is configured to focus the emitted electrons. The grid plate includes a mask section having apertures through which electron beams formed by the emitted electrons are passed, and protrusions integrally formed thereon and extending from one side of the mask section to support the mask section over the first substrate.

18 Claims, 9 Drawing Sheets

FIELD EMISSION DISPLAY HAVING GRID PLATE

CROSS REFERENCE TO RELATED APPLICATION

This application claims priority to and the benefit of Korean Patent Application No. 2003-0009439 filed on Feb. 14, 2003 in the Korean Intellectual Property Office, the contents of which are incorporated herein by reference.

BACKGROUND OF THE INVENTION (a) Field of the Invention

The present invention relates to a field emission display (FED), and more particularly, to an FED that includes emitters made of a carbon-based material and a grid plate mounted between front and rear substrates.

(b) Description of the Related Art

A type of conventional FEDs employs a triode structure of cathode electrodes, an anode electrode, and gate electrodes. The cathode electrodes, an insulation layer, and the gate electrodes are formed in this order on a first substrate on which emitters are to be formed. Openings are then formed in the gate electrodes and the insulation layer to expose the cathode electrodes, after which emitters are formed on exposed surfaces of the cathode electrodes. Further, the anode electrode and phosphor layers are formed on a second substrate.

It is often difficult to manufacture such FEDs having the triode structure. For example, it is hard to avoid forming a short between the cathode electrodes and the gate electrodes while providing emitter material into the openings of the gate electrodes and the insulation layer. Further, when the electrons emitted from the emitters are formed into electron beams and travel toward the phosphor layers, a diverging force of the electron beams is increased by influence of a positive voltage applied to the gate electrodes such that the electron beams disperse.

In an effort to overcome the problem of electron beam dispersion, a mesh-type grid plate is mounted between the first substrate and the second substrate. The grid plate enables better focusing of the electron beams emitted from the emitters.

In addition to focusing the electron beams, the grid plate also prevents damage to the first substrate (including the emitters formed thereon) when arcing results from the high voltage applied to the anode electrode. However, in practice, many of the electron beams emitted from the emitters are unable to pass through the openings of the grid plate and also experience misdirection away from their intended paths. Picture quality is significantly reduced as a result.

This is of particular concern with the FED configuration shown in FIG. 13. In the FED of FIG. 13, gate electrodes 5 are first formed on a first substrate 3 on which emitters 1 are to be formed. An insulation layer 7 is formed on the gate electrodes 5, then cathode electrodes 9 are formed on the insulation layer 7. The emitters 1 are formed on the cathode electrodes 9.

With this FED structure, most electron beams are emitted from edges of the emitters 1 and at predetermined angles to the first substrate 3. The electron beams then either arc toward a second substrate 11 while passing through openings 13*a* of a grid plate 13 or fail to pass through the openings 13*a* and strike the grid plate 13.

Therefore, many of the electron beams strike the grid plate 13 and are prevented from further movement, strike the grid plate 13 and are deflected to travel along an altered path, or pass through one of the openings 13*a* of the grid plate 13 corresponding to a pixel adjacent to the intended pixel. If the emitter 1 from which the electron beam arrows are drawn in FIG. 13 is used as an example, the electron beams emitted from this emitter 1 land on a phosphor layer 15 of the intended phosphor to illuminate the same and also land on phosphor layers 15' of pixels adjacent to the intended pixel to illuminate the same. Picture quality is reduced as the electron beams land on the phosphor layers 15' of unintended pixels.

The conventional grid plate 13 has a minimal thickness of approximately a few tens to a few hundred micrometers, and includes a plurality of openings 13*a*, each of which corresponds to one of the pixel regions. Further, lower spacers 17 are mounted in non-pixel regions and between the first substrate 3 and the grid plate 13. The lower spacers 17 maintain a uniform gap between the first substrate 3 and the grid plate 13. The grid plate 13 vibrates in response to the successive collision of electrons thereon. The vibration of the grid plate 13 occurs because of the thinness thereof and because of the distance between the lower spacers 17.

FIG. 14 is a schematic view used to describe a vibration pattern of the grid plate 13. To describe the vibration of the grid plate 13, the vibration thereof between two fixed points 19 where a pair of the lower spacers 17 is positioned will be described. An amplitude of vibration p of the grid plate 13 increases as the distance between the lower spacers 17 is enlarged. In the case where the distance between the lower spacers 17 is a few tens of millimeters, the vibration frequency bandwidth of the grid plate 13 falls to the range of the audible frequency bandwidth such that noise is generated by the grid plate 13.

To solve the problem of vibration of the grid plate 13 and the resulting noise, it is necessary to increase the number of the lower spacers 17 to reduce the distance therebetween. However, a problem with this approach is that FED manufacturing is made difficult by the resulting complicated process of arranging the larger number of lower spacers 17.

SUMMARY OF THE INVENTION

In one exemplary embodiment of the present invention, there is provided a field emission display that blocks specific paths so that electron beams varying from their intended paths are prevented or hindered from landing on the phosphor layers of incorrect pixels to thereby prevent or reduce the occurrence of illumination of these pixels and improve picture quality. Also, the field emission display prevents or reduces vibration of a grid plate caused by electrons striking the same, and avoids the difficulties associated with arranging lower spacers during the manufacturing process.

In an exemplary embodiment of the present invention, a field emission display includes a first substrate and a second substrate facing one another and having a predetermined gap therebetween. An electron emission assembly for emitting electrons is formed on the first substrate, and an illumination assembly for displaying images responsive to the electrons emitted from the electron emission assembly is formed on the second substrate. A grid plate is mounted between the first and second substrates and configured to focus the electrons emitted from the electron emission assembly. The grid plate includes protrusions integrally formed thereon and extending from at least one side thereof.

The electron emission assembly includes electron emission sources, and electrodes for causing the emission of electrons from the electron emission sources. The electrodes include cathode electrodes and gate electrodes formed in a stripe pattern. The cathode electrodes and the gate electrodes are substantially perpendicular to one another, and insulated from one another by an insulation layer.

The protrusions may be mounted on the insulation layer, and in the case where the field emission display further includes an auxiliary insulation layer formed on an uppermost layer of the first substrate, the protrusions are mounted on the auxiliary insulation layer.

The grid plate further includes a mask section having apertures through which electrons are passed. The protrusions may be formed between the apertures formed in the mask section and along one direction to thereby form a stripe pattern. Also, the protrusions may be formed between the apertures formed in the mask section and along first and second directions that are substantially perpendicular to each other to thereby form a lattice pattern.

In another exemplary embodiment of the present invention, the protrusions are formed between at most every other row of the apertures formed in the mask section, and along one direction to thereby form a stripe pattern. Also, the protrusions gradually decrease in cross-sectional area in a direction away from the mask section.

In yet another exemplary embodiment of the present invention, a field emission display includes a first substrate and a second substrate facing one another and having a predetermined gap therebetween. An electron emission assembly for emitting electrons by generating an electric field is formed on the first substrate. An illumination assembly for realizing a display of images responsive to electrons emitted from the electron emission assembly is formed on the second substrate. A grid plate is mounted between the first and second substrates and configured to focus the electrons emitted from the electron emission assembly. The grid plate includes protrusions extending from at least one side thereof, wherein each of the protrusions has a general shape of an elongated bar.

BRIEF DESCRIPTION OF THE DRAWINGS

The accompanying drawings, which together with the specification, illustrate exemplary embodiments of the present invention, and, together with the description, serve to explain the principles of the present invention.

DETAILED DESCRIPTION

Exemplary embodiments of the present invention will now be described in detail with reference to the accompanying drawings.

Figure 1A:
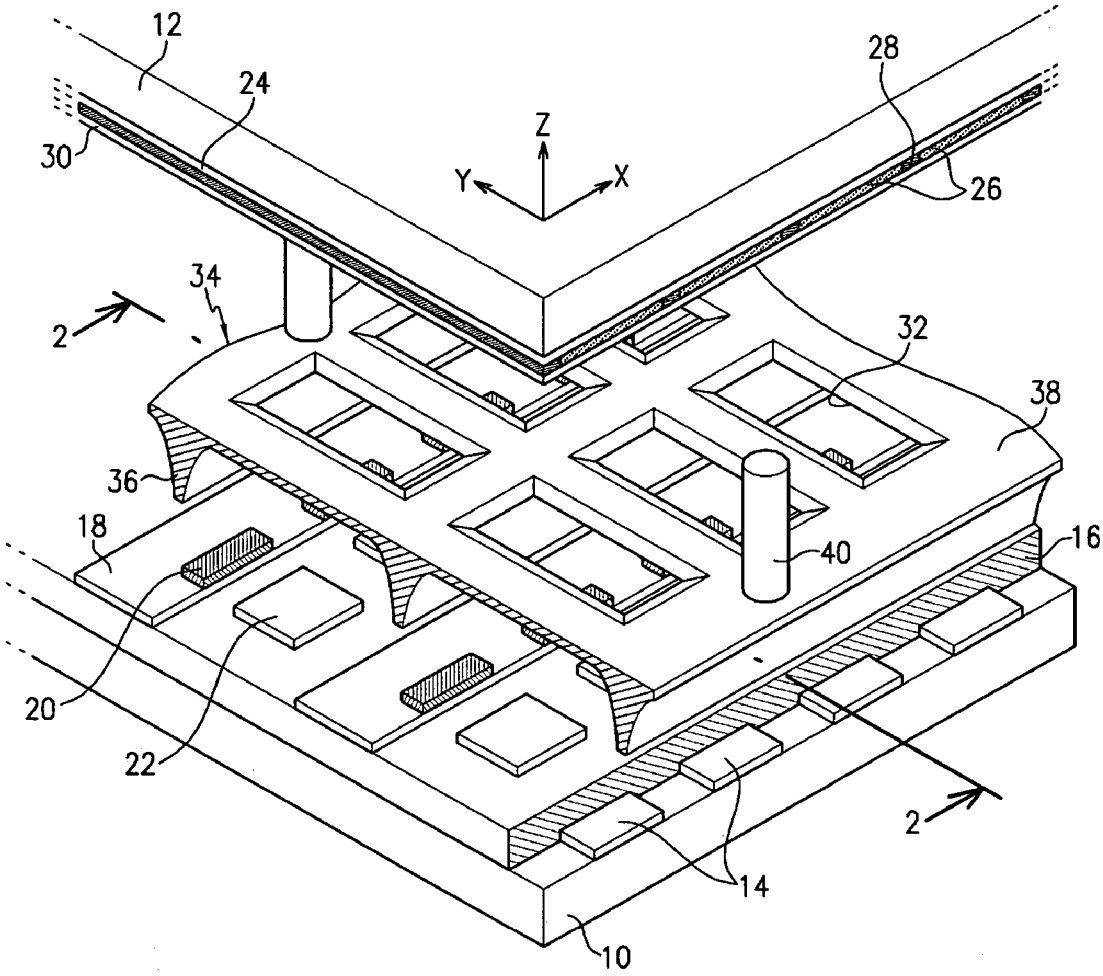
FIG. 1A is a partial exploded perspective and pictorial view of a field emission display according to an exemplary embodiment of the present invention.
Figure 1B:
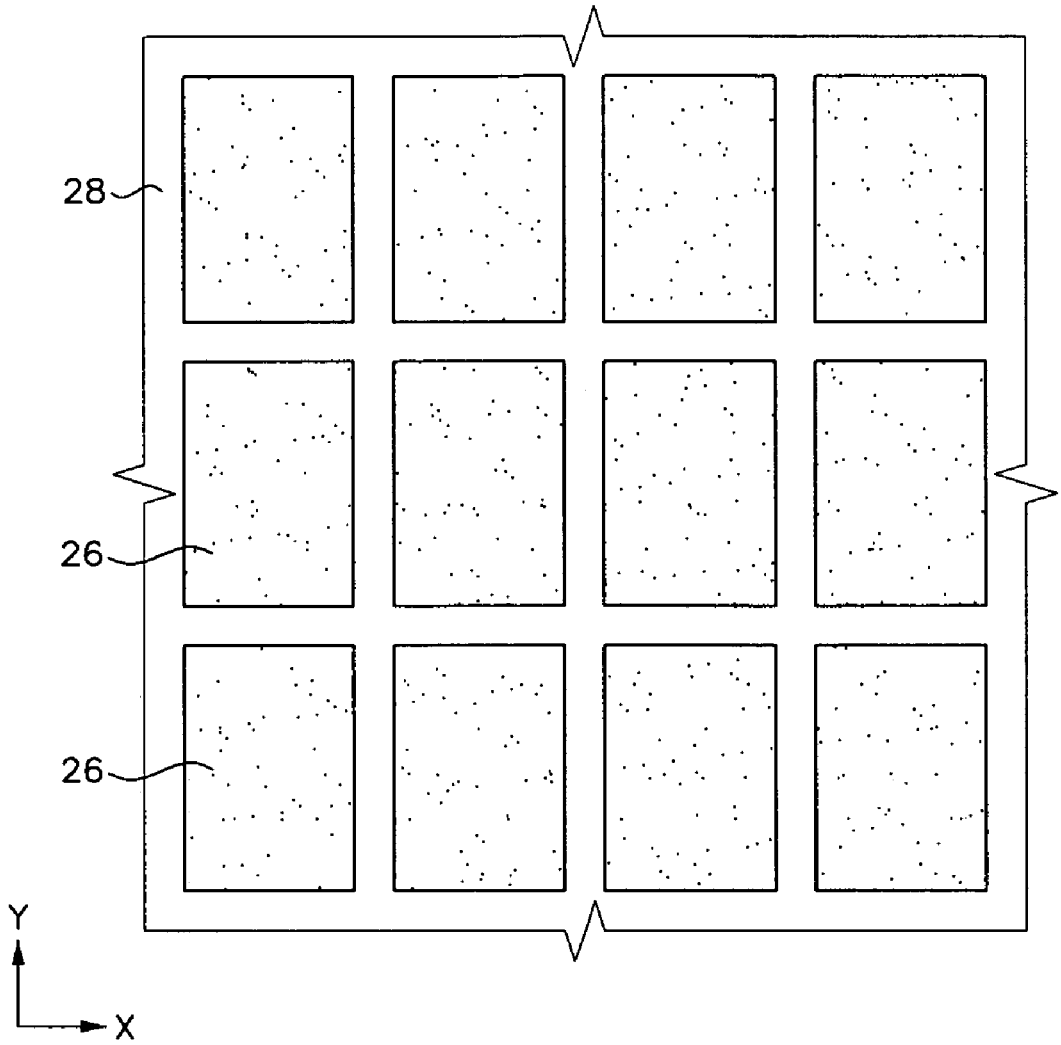
FIG. 1B is a partial plan view of phosphor regions surrounded by a black matrix in the FED of FIG. 1A, as formed on an anode electrode of a second substrate.
Figure 2:
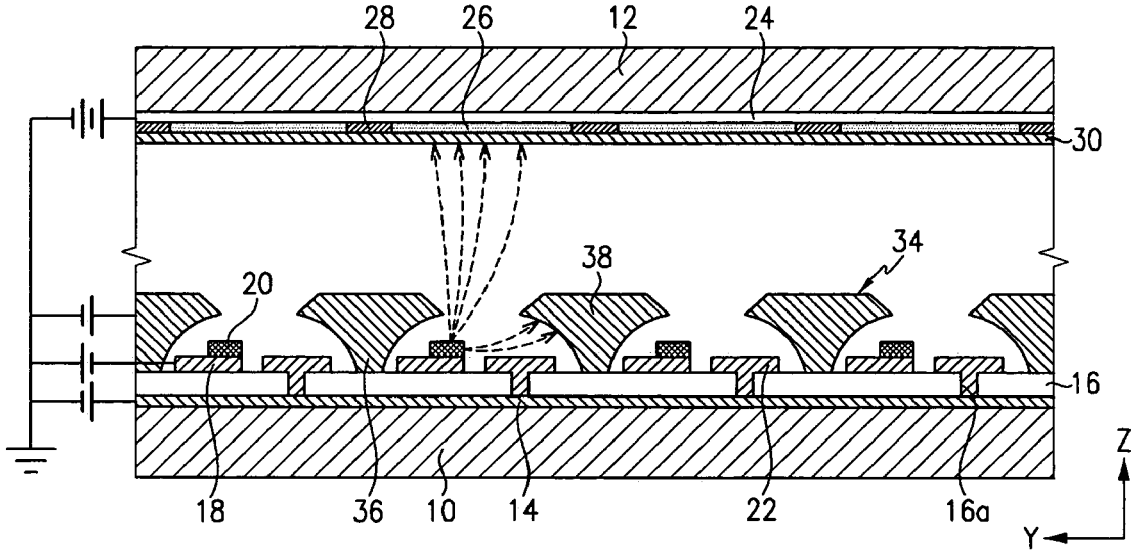
FIG. 2 is a partial sectional view of the field emission display of FIG. 1A taken along the line 2-2, shown in an assembled state.

FIG. 1A is a partial exploded perspective view of a field emission display (FED) according to an exemplary embodiment of the present invention, FIG. 1B is a partial plan view of phosphor regions surrounded by a black matrix in the FED of FIG. 1A, and FIG. 2 is a partial sectional view of the FED of FIG. 1A taken along the line 2-2 and shown in an assembled state.

As shown in FIGS. 1A and 2, the FED includes a first substrate 10 and a second substrate 12. The first substrate 10 and the second substrate 12 face one another with a predetermined gap therebetween. A structure for enabling the emission of electrons by forming an electric field is provided on the first substrate 10, and a structure for enabling the realization of images (e.g., predetermined images) by interacting with emitted electrons is provided on the second substrate 12.

In more detail, gate electrodes 14, each having an elongated stripe shape, are formed on the first substrate 10 in a stripe pattern along one direction (for example, a Y axis direction of the drawings). Further, an insulation layer 16 is formed over an entire surface of the first substrate 10 covering the gate electrodes 14. Cathode electrodes 18, each having an elongated stripe shape, are formed on the insulation layer 16 in a stripe pattern along a direction substantially perpendicular to the direction of long axes of the gate electrodes 14 (for example, an X axis direction of the drawings).

Pixel regions are defined by the "intersection" of the gate electrodes 14 and the cathode electrodes 18. The gate electrodes 14 and the cathode electrodes 18 do not physically intersect one another. What is meant by "intersection" or "intersect" between the gate and cathode electrodes hereinafter is that a projection of the gate electrodes intersect with the cathode electrodes. Electron emission sources (i.e., emitters 20) are positioned along one long edge of each of the cathode electrodes 18 corresponding to the location of the pixels. Further, counter electrodes 22 are provided along the long edge of and at a predetermined distance from each of the cathode electrodes 18. In other words, the counter electrodes are mounted between the cathode electrodes at a predetermined distance from the same. Each emitter 20 is substantially aligned with a corresponding counter electrode 22. The counter electrodes 22 attract an electric field of the cathode electrodes 14 above the insulation layer 16.

The counter electrodes 22 are electrically connected to and in the described embodiment in contact with the gate electrodes 14 through via openings 16*a* formed in the insulation layer 16. Therefore, when a predetermined drive voltage is applied to the gate electrodes 14 such that an electric field for electron emission is formed between the counter electrodes 22 and the emitters 20, a voltage of the gate electrodes 14 is attracted in the vicinity of the emitters 20 such that a greater electric field is concentrated at the emitters 20. This results in better emission of electrons from the emitters 20.

The emitters 20, each depicted as a cross-hatched box, are made of a carbon-based material such as, for example, carbon nanotubes, graphite, diamond, diamond-like carbon, or $C_{60}$ (Fullerene), or any suitable mixture of two or more of these carbon-based materials.

Formed on a surface of the second substrate 12 that faces the first substrate 10 are a planar anode electrode 24, and R, G, and B phosphor layers 26 formed on the anode electrode 24. The R, G, and B phosphor layers 26 as depicted in FIG. 1B are formed in a predetermined pattern, for example, in a matrix pattern having rows and columns of phosphor regions, each phosphor region corresponding to one of the pixel regions, and at a predetermined distance with respect to one another. Further, as depicted in FIG. 1B, a black matrix 28 having a lattice pattern surrounds the phosphor regions to improve screen contrast. In other words, each phosphor region of the phosphor layers 26 is disposed within a corresponding one of the cells defined by the lattice pattern of the black matrix 28.

Finally, a planar metal film 30 made for example of aluminum is formed on the phosphor layers 26 and the black matrix 28. The metal film 30 increases screen brightness by providing a metal back effect, which is known to those skilled in the art, and acts to transmit an electric charge accumulated on the phosphor layers 26 to outside the FED to improve voltage resistance characteristics of the same.

The first substrate 10 and the second substrate 12 structured as in the above are sealed using a sealant in a state where the substrates face one another with a predetermined gap therebetween. The air between the first substrate 10 and the second substrate 12 is exhausted to form a vacuum therebetween to thereby complete the FED.

Further, a mesh-type grid plate 34 having a plurality of apertures 32 is positioned between the first and second substrates 10 and 12. The apertures 32 may be formed such that one or more of the same are located in each of the pixel regions where the gate electrodes 14 and the cathode electrodes 18 intersect. The grid plate 34 focuses the electrons emitted from the emitters 20, and prevents or reduces damages to the first substrate 10 caused by arcing occurring in the FED.

The grid plate 34 includes protrusions 36 on a surface facing the first substrate 10. The protrusions 36 are integrally formed on the grid plate 34 and are configured to block electron beams directed toward the phosphor layers 26 of unintended pixels when electron beams are emitted from the emitters 20 during operation of the FED.

Figure 3:
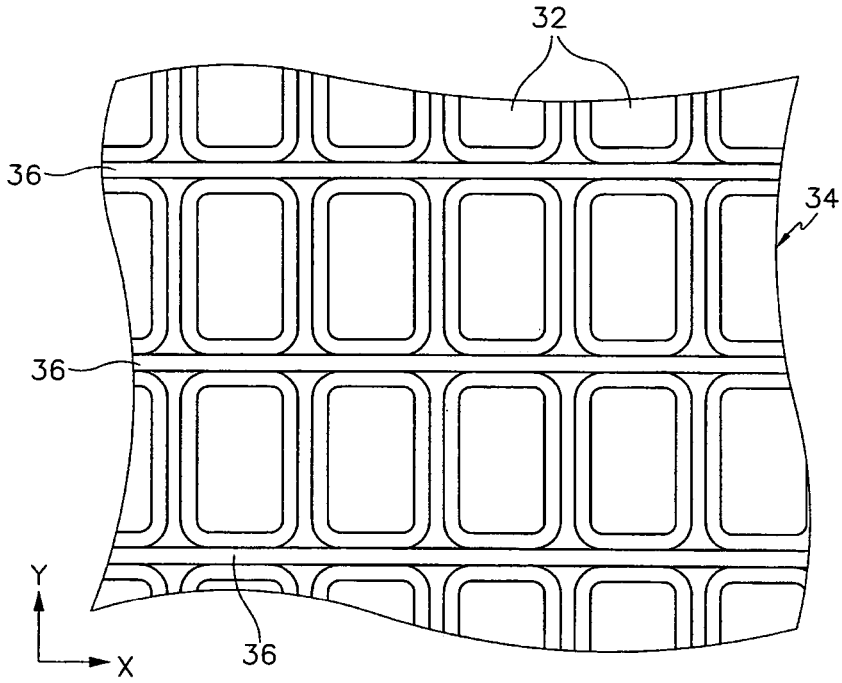
FIG. 3 is a partial plan view of a rear of a grid plate according to an exemplary embodiment of the present invention.
Figure 4:
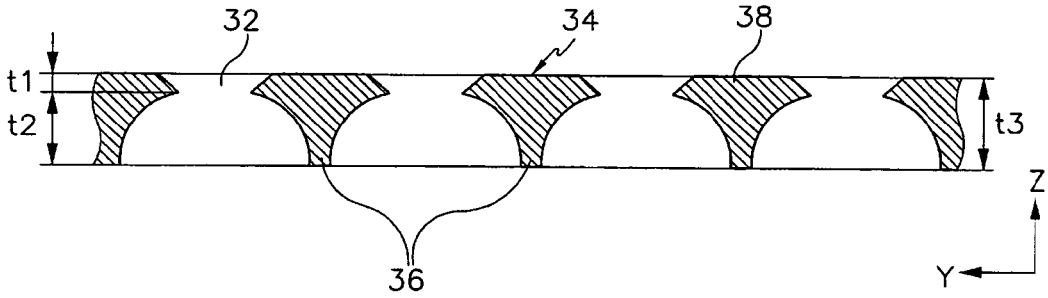
FIG. 4 is a partial sectional view of the grid plate of FIG. 3.

FIG. 3 is a partial plan view of a rear of the grid plate 34, and FIG. 4 is a partial sectional view of the grid plate 34 of FIG. 3.

With reference to FIGS. 3 and 4, the grid plate 34 includes a mask section 38 having a predetermined thickness t1 and the apertures 32 formed such that each aperture corresponds to one of the pixel regions. Protrusions 36, each having a general shape of an elongated bar, are formed extending from the mask section 38 on a side of the same that faces the first substrate 10. The protrusions 36 extend in a direction toward the first substrate 10 as described above, and have a predetermined thickness t2. Further, the protrusions 36 are formed protruding toward the first substrate 10 in a stripe pattern along one direction of the grid plate 34, for example, along the direction of the cathode electrodes 18 (X axis direction).

The protrusions 36 extend from the mask section 38 to contact an uppermost layer formed on the first substrate 10. In other words, the protrusions 36 contact the insulation layer 16, such that the grid plate 34 is mounted on the first substrate 10 without the use of spacers. Therefore, the mask section 38 of the grid plate 34 and the apertures 32 formed in the mask section 38 are separated from the insulation layer 16 and the cathode electrodes 18 at a distance approximately corresponding to the thickness t2 of the protrusions 36. The thickness t2, for example, may be between approximately 30 μm and approximately 200 μm.

Distal ends of the protrusions 36 are positioned parallel to the cathode electrodes 18 (when viewed from above) in non-pixel regions between the same. As a result, the protrusions 36 act as partition walls to separate the cathode electrodes 18 from one another. This partition wall function of the protrusions 36 is such that the electron beams emitted from the emitters 20 that stray from their intended paths and toward the phosphor layers 26 of pixels adjacent to the target pixels are blocked, to thereby prevent the illumination of unintended pixels.

Because of the positioning of the protrusions 36 of the grid plate 34 at non-pixel regions between the cathode electrodes 18 of the first substrate 10, it may be difficult to ensure the width of the cathode electrodes 18 and the counter electrodes 22. Further, it may be difficult to ensure a tolerance during assembly of the grid plate 34 and the first substrate 10.

With this in mind, the protrusions 36 are formed gradually decreasing in cross-sectional area in a direction toward the first substrate 10 starting from the mask section 38, such that portions of the protrusions 36 that contact the insulation layer 16 are as small as possible. For example, the cross-sectional formation of the protrusions 36 should be symmetrical about a line intersecting the same in a lengthwise direction such that a sufficient supporting force is provided to the grid plate 34.

Hence, in addition to replacing the conventional lower spacers, the protrusions 36 also act as partition walls to prevent the electron beams from landing on the phosphor layers 26 of unintended pixels. As described above, the protrusions 36 are integrally formed to the mask section 38. The grid plate 34 with this structure may be produced as described in the following.

A metal plate (not shown) having a thickness t3 that is a combination of the thickness t1 of the mask section 38 and the thickness t2 of the protrusions 36 is used. Using two masks (not shown) having different opening sizes, a conventional two-sided asymmetrical etching process is performed on the metal plate. The grid plate 34 including the mask section 38 and the protrusions 36 is therefore formed.

A plurality of upper spacers 40 are mounted in non-pixel regions between the second substrate 12 and the grid plate 34. The upper spacers 40 maintain a substantially uniform gap between the second substrate 12 and the grid plate 34.

In the FED structured as in the above, predetermined external voltages are applied to the gate electrodes 14, the cathode electrodes 18, the anode electrode 24, and the grid plate 34 to thereby drive the FED. As an example, a positive voltage of a few to a few tens of volts is applied to the gate electrodes 14, a negative voltage of a few to a few tens of volts is applied to the cathode electrodes 18, a positive voltage of a few hundred to a few thousand volts is applied to the anode electrode 24, and a positive voltage of a few to a few hundred volts is applied to the grid plate 34. The biasing of the electrodes and the grid plate 34 are schematically depicted on the left side of FIG. 2, for example.

Therefore, with reference to FIG. 2, an electric field is generated in the vicinity of the emitters 20 by the difference in voltage between the gate electrodes 14 and the cathode electrodes 18 such that electrons are emitted from the emitters 20. The resulting electron beams are attracted by the positive voltage applied to the grid plate 34 to pass through the apertures 32 thereof while traveling toward the second substrate 12. After passing through the apertures 32 of the grid plate 34, the electron beams are attracted by the high positive voltage applied to the anode electrode 24 to thereby land on the phosphor layers 26 and illuminate the same.

However, some of the electron beams emitted from the emitters 20 are attracted by the positive voltage applied to the counter electrodes 22 such that they are misdirected and are unable to pass through the apertures 32 of the grid plate 34. Although these misdirected electron beams travel toward the phosphor layers 26 of the wrong pixels, since the protrusions 36 of the grid plate 34 are positioned in the non-pixel regions between the cathode electrodes 18, the protrusions 36 block and retain these electron beams and prevent further movement of the same.

Therefore, the present invention prevents or reduces the occurrence of the illumination of the wrong pixels to improve vertical resolution of the picture, and improves the clarity of characters in the vertical direction to enable the same to be more easily read. Further, since lower spacers are unneeded in the exemplary embodiment of the present invention, the procedure in which lower spacers are aligned can be omitted from the manufacturing process. Finally, vibration of the grid plate 34 is prevented or reduced by the protrusions 36.

Figure 5:
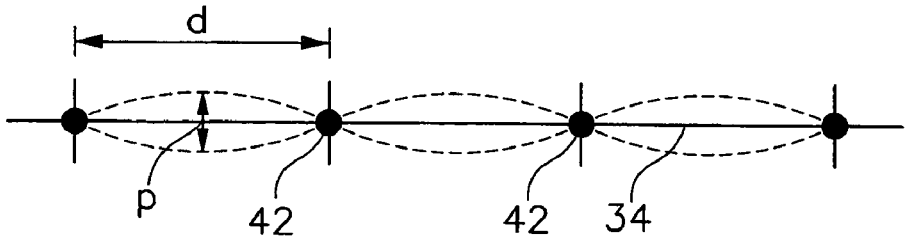
FIG. 5 is a schematic view used to illustrate a vibration pattern of the grid plate of FIG. 3.

FIG. 5 is a schematic view used to describe a vibration pattern of the grid plate of FIG. 3. In order to explain the vibration of the grid plate 13, the vibration thereof between pairs of fixed points 42 where the protrusions 36 are located will be described.

Since a distance d between two of the fixed points 42 corresponds directly to a pitch of the protrusions 36, an amplitude of vibration p of the grid plate 34 is reduced or minimized by reductions in the distance d between the fixed points 42. Therefore, problems associated with the vibration of the grid plate 34 (for example, the problem of noise) may be avoided, and the pitch of the protrusions 36 may be adjusted as needed so that the vibrational frequency bandwidth of the grid plate 34 may be changed from the audible frequency bandwidth.

FIGS. 6-11 are related to various other exemplary embodiments of the present invention. It should be noted that these additional exemplary embodiments use the basic configuration of the exemplary embodiment described above, so only the differences in the structures will be explained in detail.

Figure 6:
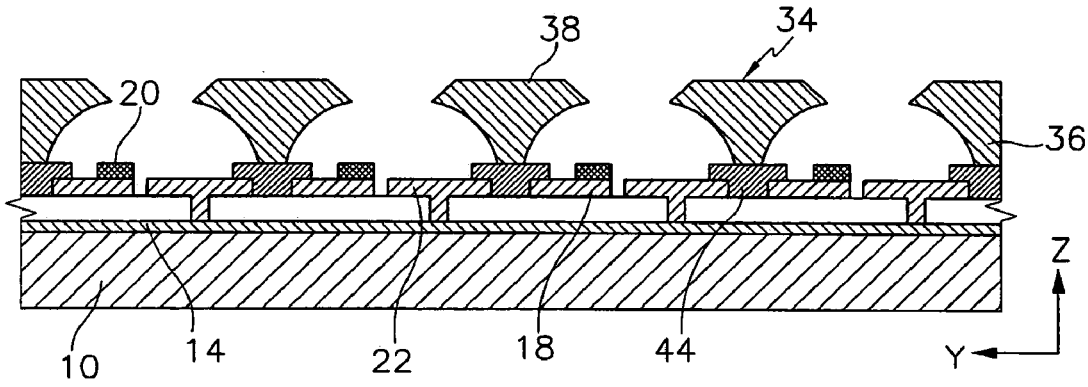
FIG. 6 is a partial sectional view of a field emission display according to another exemplary embodiment of the present invention.

Referring first to FIG. 6, auxiliary insulation layers 44 are formed on the insulation layer 16 and extend between the cathode electrodes 18 and the corresponding counter electrodes 22 in the non-pixel regions. In other words, each auxiliary insulation layer 44 is formed between two adjacent rows of pixels, each row defined by the corresponding cathode electrode 18 and counter electrodes 22. The protrusions 36 of the grid plate 34 are positioned on the auxiliary insulation layers 44.

With this configuration, insulation characteristics between the conductors of the grid plate 34, the cathode electrodes 18, and the counter electrodes 22 are ensured. Also, the tolerance when the grid plate 34 is mounted over the first substrate 10, and the widths of the cathode electrode 18 and the counter electrodes 22 can be easily ensured.

Figure 7:
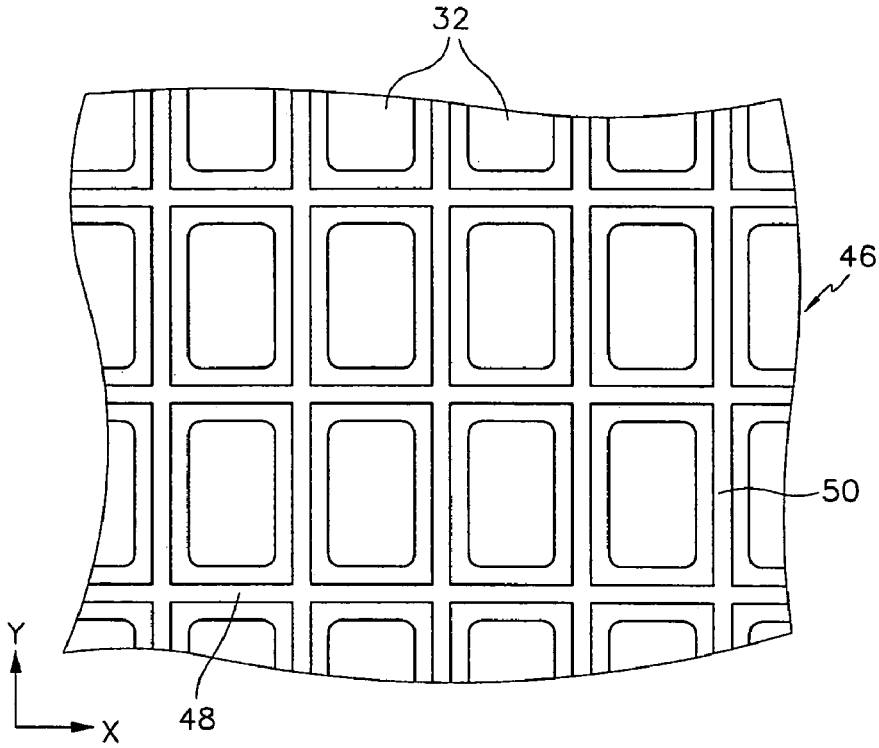
FIGS. 7 and 8 are respectively a partial plan view of a rear of a grid plate and a partial sectional view of a field emission display according to yet another exemplary embodiment of the present invention.
Figure 8:
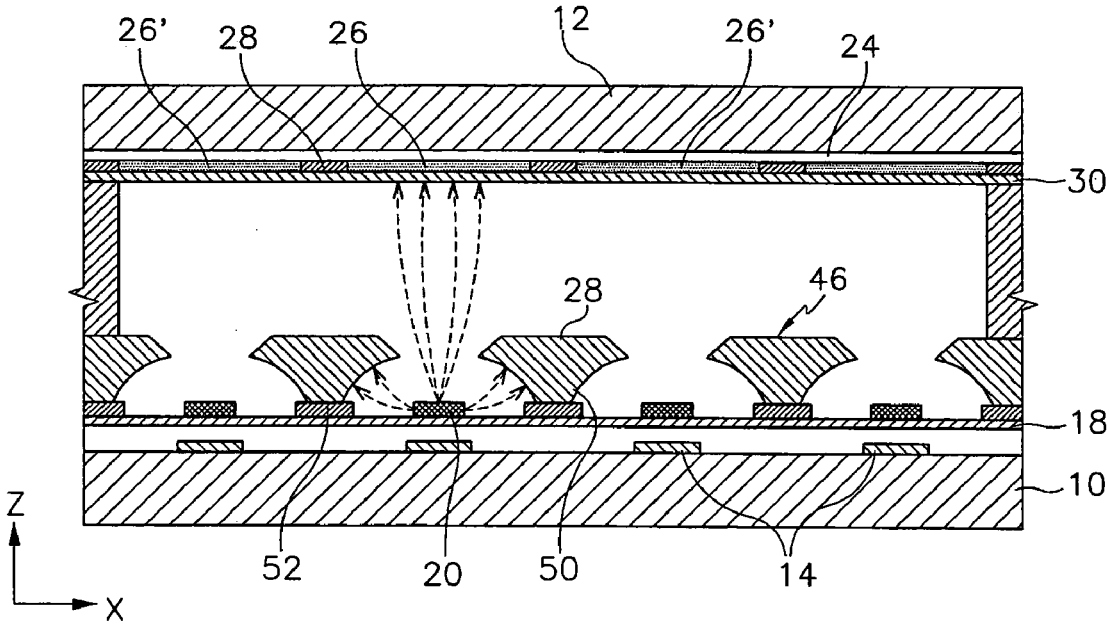

FIGS. 7 and 8 show views of yet another exemplary embodiment of the present invention. A grid plate 46 includes integrally formed first protrusions 48 that are formed along the direction of the cathode electrodes 18 (X axis direction) between the array of apertures 32 of the mask section 38, and integrally formed second protrusions 50 that are formed along the direction of the gate electrodes 14 (Y axis direction) between the array of apertures 32 of the mask section 38. Therefore, the first and second protrusions 48 and 50 are formed in a lattice pattern.

Also, formed on an uppermost layer of the first substrate 10 and corresponding to the lattice pattern of the first and second protrusions 48 and 50 is an auxiliary insulation layer 52. Distal ends of the first and second protrusions 48 and 50 are positioned on the auxiliary insulation layer 52. The auxiliary insulation layer 52 prevents a short between the cathode electrodes 18 and the grid plate 46 when the second protrusions 50, which are formed along the direction of the gate electrodes 14 (Y axis direction), are mounted on the cathode electrodes 18.

The second protrusions 50, with reference to FIG. 8, prevent the spread of electron beams in the X axis direction by blocking the electron beams that are misdirected toward the wrong pixels where phosphor layers 26' of another color are located. Accordingly, the second protrusions 50 reduce the occurrences of or prevent mis-landing of the electron beams such that illumination of the wrong pixels is prevented or its occurrence is reduced, and overall color purity is improved.

Figure 9:
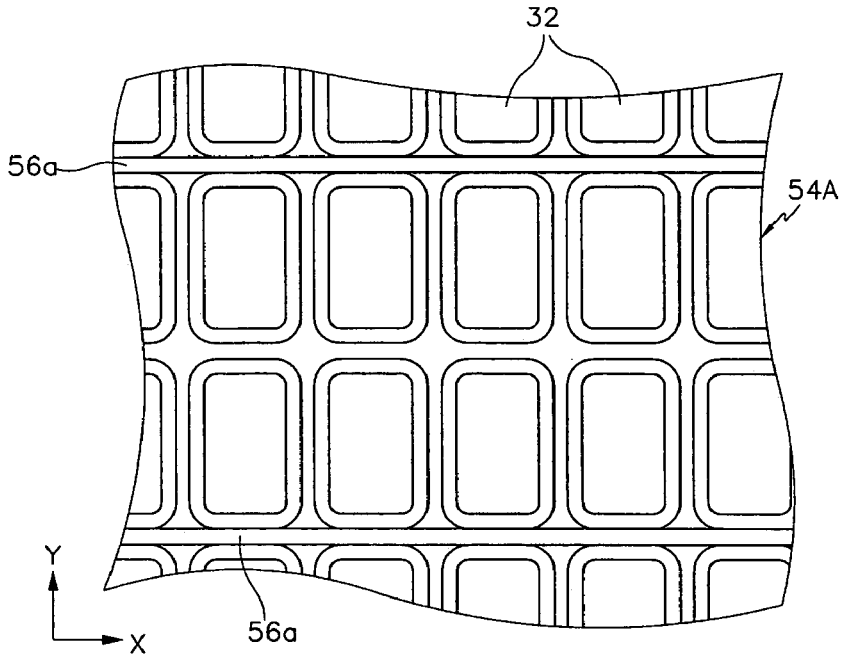
FIGS. 9, 10, and 11 are partial plan views of a rear of a grid plate according to yet another exemplary embodiment of the present invention.
Figure 10:
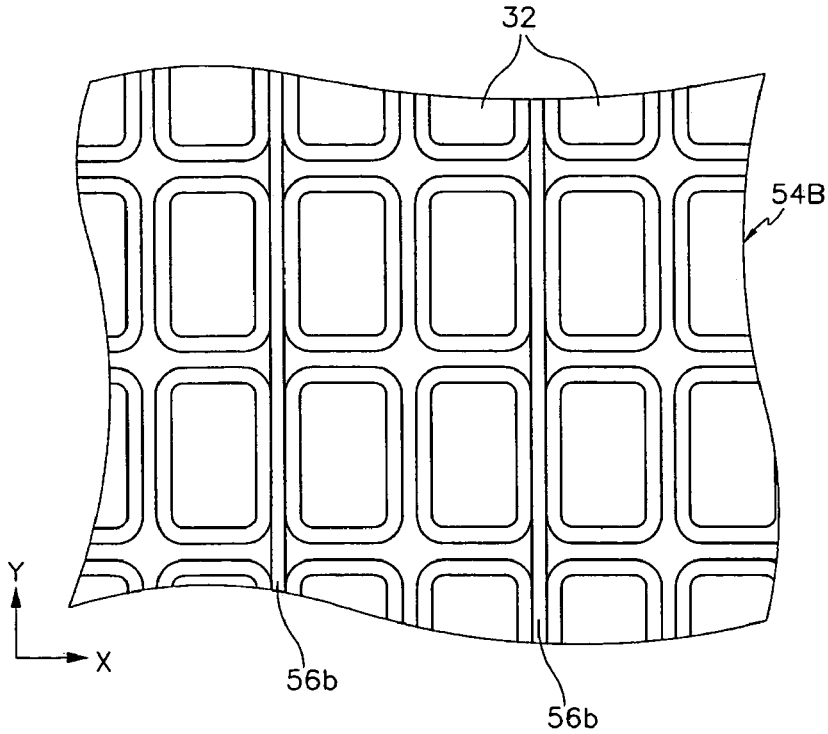
Figure 11:
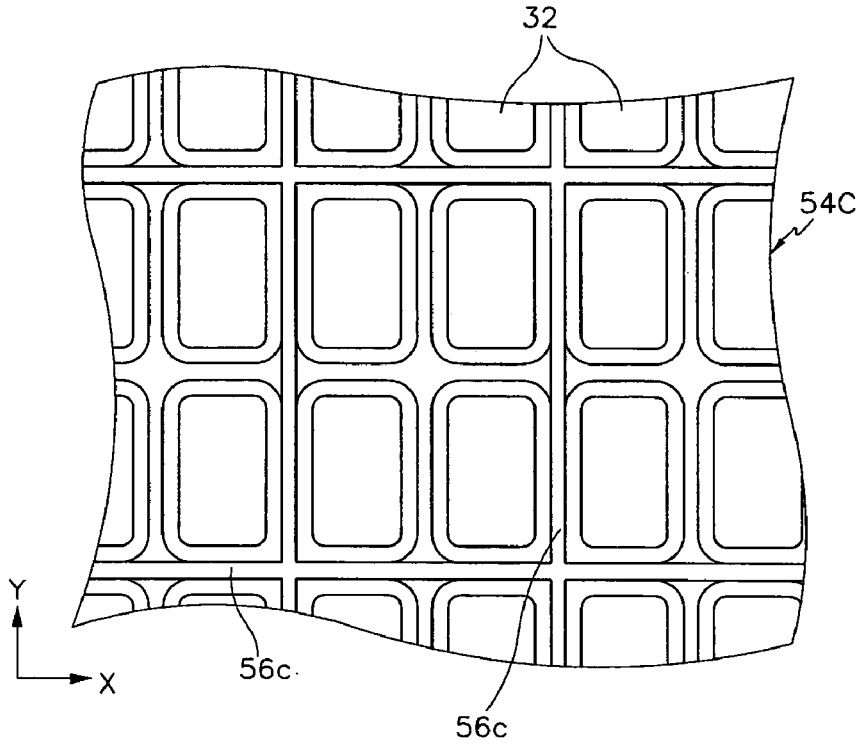

FIGS. 9, 10, and 11 show still another exemplary embodiment of the present invention. In this exemplary embodiment, there are slight variations to the basic configuration in which protrusions 56*a*, 56*b*, and 56*c* respectively of grid plates 54A, 54B, and 54C are extended between rows and/or columns of at most every other aperture 32.

In the configuration shown in FIG. 9, the protrusions 56*a*, each having a general shape of an elongated bar, are formed in a stripe pattern along the direction of the cathode electrodes (X axis direction). In the configuration shown in FIG. 10, the protrusions 56*b*, each having a general shape of an elongated bar, are formed in a stripe pattern along the direction of the gate electrodes (Y axis direction). Further, in the configuration shown in FIG. 11, the protrusions 56*c*, each having a general shape of an elongated bar, are formed in a lattice pattern along the direction of both the cathode electrodes (X axis direction) and the gate electrodes (Y axis direction). Again, in each of these configurations, the protrusions 56*a*, 56*b*, and 56*c* are extended between rows and/or columns of at most every other aperture 32.

With this placement of the protrusions 56*a*, 56*b*, and 56*c*, the thickness of the mask section 38 in the area of the pixel regions may be reduced to a greater degree or minimized. This allows the apertures 32 of the grid plates 54A, 54B, and 54C to be more minutely formed, and this, in turn, further prevents electron beams from being misdirected toward the phosphor layers 26 of wrong pixels. Overall picture quality is improved as a result.

In the additional exemplary embodiments shown in FIGS. 9, 10, and 11, the thickness of the mask section 38 may, for example, be between approximately 30 μm and approximately 200 μm, and an area of each of the apertures 32 may, for example, be between approximately 0.04 $mm^2$ and approximately 5.00 $mm^2$. However, the thickness of the mask section 38, the area of the apertures 32, and the spacing between the protrusions 56*a*, 56*b*, and 56*c* may be varied as needed depending on the particular characteristics of the FED to which the grid plates 54A, 54B, 54C are applied.

Figure 12:
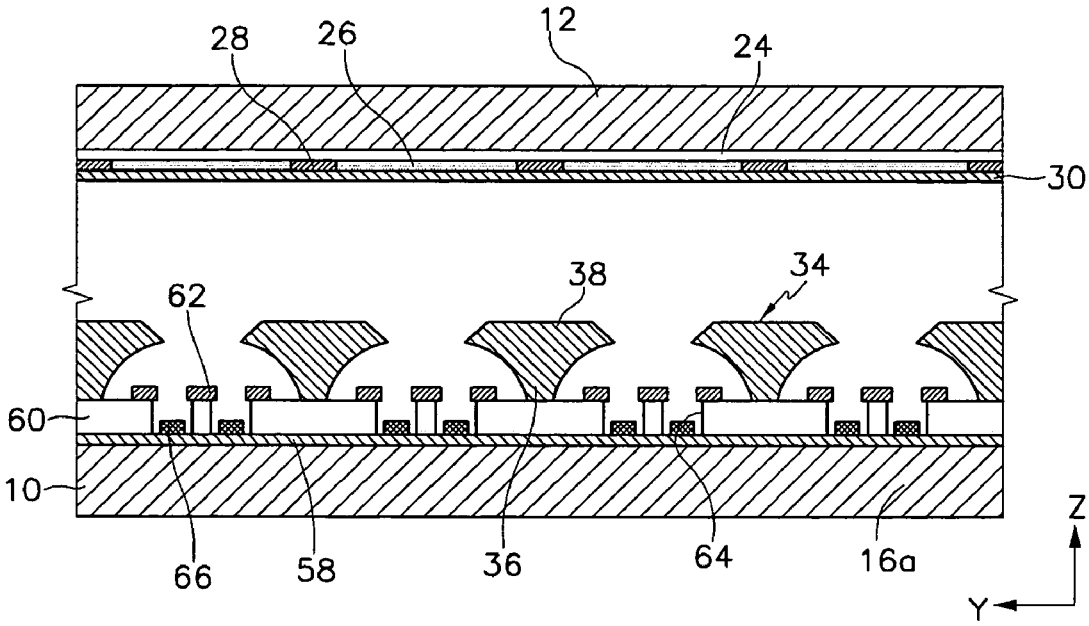
FIG. 12 is a partial sectional view of a field emission display according to still yet another exemplary embodiment of the present invention.
Figure 13:
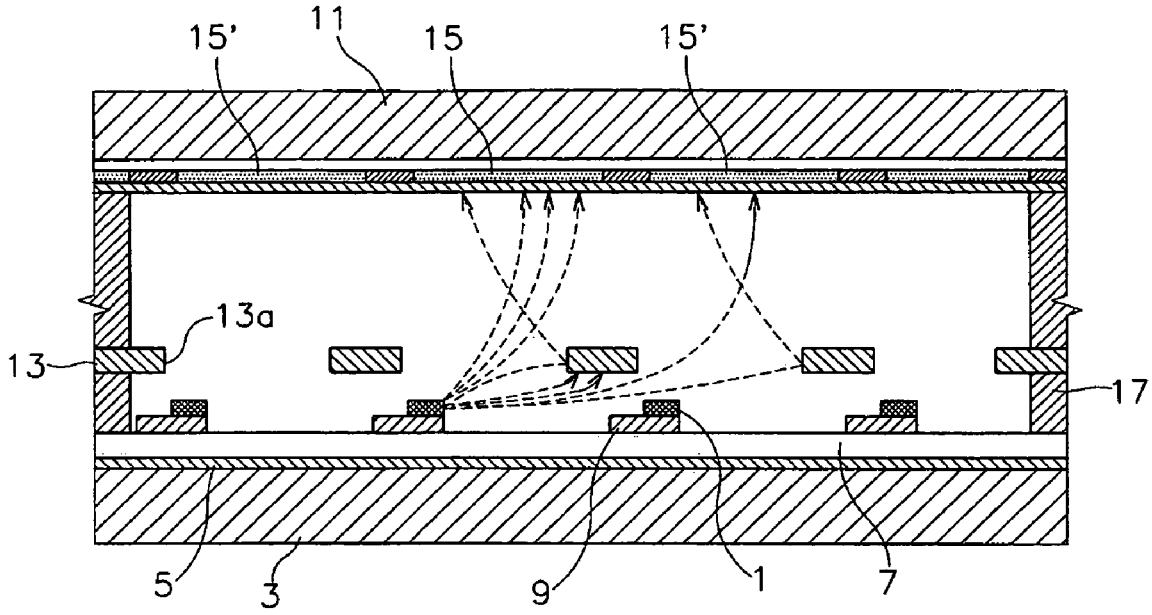
FIG. 13 (Prior Art)
FIG. 13 is a partial sectional view of a conventional field emission display.
Figure 14:
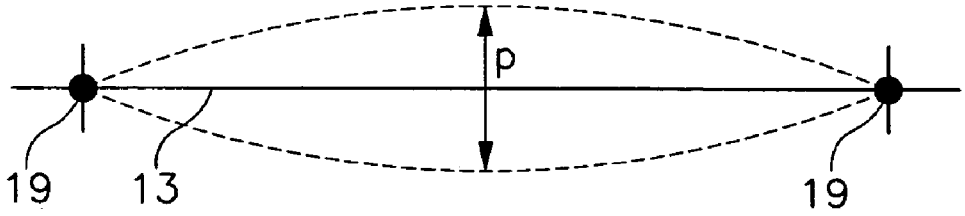
FIG. 14 (Prior Art)
FIG. 14 is a schematic view used to describe a vibration pattern of a grid plate.

A structure to enable the emission of electrons by forming an electric field may be realized using an alternative configuration as shown in FIG. 12.

In more detail, cathode electrodes 58, each having an elongated stripe shape, are formed in a stripe pattern and along one direction of a first substrate 10. Further, an insulation layer 60 is formed over an entire surface of the first substrate 10 covering the cathode electrodes 58, and gate electrodes 62, each having an elongated stripe shape, are formed on the insulation layer 60 in a stripe pattern and along a direction substantially perpendicular to the cathode electrodes 58.

Openings 64 that pass through the gate electrodes 62 and the insulation layer 60 are formed at areas where the cathode electrodes 58 and the gate electrodes 62 intersect to thereby expose the cathode electrodes 58. Electron emission sources, (i.e., emitters 66) are formed in the openings 64 on the exposed cathode electrodes 58.

The processes involved in the emission of electrons from the emitters 66 and the landing of the electrons on the phosphor layers 26 to realize the display of images are substantially the same as those involved in the exemplary embodiments of FIGS. 1-11. A detailed description will therefore not be provided.

In the FED of the present invention described above, electron beams emitted from the emitters and misdirected toward the phosphor layers of the wrong pixels are intercepted by the protrusions of the grid plate. Therefore, the present invention prevents or reduces the occurrence of the illumination of the wrong pixels, thereby improving vertical resolution and color purity.

Further, lower spacers used in conventional FEDs are not used in the present invention such that the procedure in which lower spacers are aligned can be omitted from the manufacturing process. Finally, the amplitude of vibration of the grid plate caused by the electron beams striking the same is reduced or minimized, thereby limiting the noise generated by the grid plate.

Although the present invention has been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims and equivalents thereof.

What is claimed is:

1. A field emission display, comprising:

a first substrate and a second substrate facing one another and having a predetermined gap therebetween;

an electron emission assembly formed on the first substrate for emitting electrons;

an illumination assembly formed on the second substrate for displaying images responsive to electrons emitted from the electron emission assembly; and a grid plate mounted between the first and second substrates and configured to focus the electrons emitted from the electron emission assembly, wherein the grid plate includes protrusions integrally formed thereon and extending from at least one side thereof, and wherein the protrusions form a barrier configured to receive misdirected electrons of the electrons emitted from the electron emission assembly to hinder the misdirected electrons from hitting an unintended portion of the illumination assembly.

2. The field emission display of claim 1, wherein the electron emission assembly comprises electron emission sources and electrodes for causing the emission of electrons from the electron emission sources, wherein the electrodes include cathode electrodes and gate electrodes formed in a stripe pattern, and wherein the cathode electrodes and the gate electrodes are substantially perpendicular to one another and insulated from one another by an insulation layer.

3. The field emission display of claim 2, wherein the electron emission sources are made of a carbon-based material and have a substantially uniform thickness.

4. The field emission display of claim 3, wherein the carbon-based material is any one selected from a group consisting of carbon nanotubes, graphite, diamond, diamond-like carbon and C60 (Fullerene), or a mixture of at least two of the carbon nanotubes, graphite, diamond, diamond-like carbon and C60 (Fullerene).

5. The field emission display of claim 2, wherein the cathode electrodes are formed on the insulation layer over the gate electrodes, and the electron emission sources are mounted on the cathode electrodes.

6. The field emission display of claim 5, wherein the protrusions are mounted on the insulation layer.

7. The field emission display of claim 5, wherein the electron emission assembly further comprises counter electrodes mounted between the cathode electrodes at a predetermined distance from the same.

8. The field emission display of claim 7, wherein the counter electrodes are electrically connected to the gate electrodes through via openings formed in the insulation layer such that the counter electrodes are electrically connected to the gate electrodes.

9. The field emission display of claim 2, wherein the gate electrodes are formed on the insulation layer over the cathode electrodes, and the electron emission sources are mounted on the cathode electrodes.

10. The field emission display of claim 9, wherein the protrusions are mounted on the insulation layer.

11. The field emission display of claim 1, wherein the illumination assembly comprises an anode electrode, and red, green, and blue phosphor layers formed adjacent to the anode electrode.

12. The field emission display of claim 11, wherein the illumination assembly further comprises a metal film formed adjacent to the phosphor layers.

13. The field emission display of claim 1, further comprising an auxiliary insulation layer formed on an uppermost layer of the first substrate, and the protrusions are mounted on the auxiliary insulation layer.

14. The field emission display of claim 1, wherein the grid plate further includes a mask section having apertures through which electrons are passed.

15. The field emission display of claim 14, wherein the protrusions are formed between the apertures formed in the mask section and along one direction to thereby form a stripe pattern.

16. The field emission display of claim 14, wherein the protrusions are formed between the apertures formed in the mask section and along first and second directions that are substantially perpendicular to each other to thereby form a lattice pattern.

17. The field emission display of claim 14, wherein the protrusions are formed between at most every other row of the apertures formed in the mask section and along one direction to thereby form a stripe pattern.

18. The field emission display of claim 14, wherein the protrusions gradually decrease in cross-sectional area in a direction away from the mask section.

* * * * *